United States Patent [19]

Jacobsson

[11] 4,092,006

[45] May 30, 1978

[54] THREAD STORAGE AND DELIVERY DEVICE

[75] Inventor: Kurt Arne Gunnar Jacobsson, Ulricehamn, Sweden

[73] Assignee: Aktiebolaget IRO, Ulricehamn, Sweden

[21] Appl. No.: 746,374

[22] Filed: Dec. 1, 1976

[30] Foreign Application Priority Data

Dec. 1, 1975 Germany ..... 2553935

[51] Int. Cl.[2] ..... B65H 51/20

[52] U.S. Cl. ..... 242/47.01; 242/47.12

[58] Field of Search ..... 242/47.01–47.13, 242/47, 82, 83; 66/132 R; 139/122 R

[56] References Cited

U.S. PATENT DOCUMENTS

| | | | |
|---|---|---|---|
| 3,720,384 | 3/1973 | Rosen | 242/47.01 |
| 3,737,112 | 6/1973 | Tellerman et al. | 242/47.12 X |
| 3,776,480 | 12/1973 | Lawson | 242/47.01 |
| 3,791,598 | 2/1974 | Vischiani et al. | 242/47.12 |
| 3,944,156 | 3/1976 | Jacobsson et al. | 242/47.12 |

*Primary Examiner*—Stanley N. Gilreath
*Attorney, Agent, or Firm*—Blanchard, Flynn, Thiel, Boutell & Tanis

[57] ABSTRACT

A thread storage and delivery device for textile machines, including a housing having a thread supply device rotatably supported thereon and defining a thread channel, a rotatably supported drum axle, a storage drum, and a gearing arrangement with at least one driven wheel which can be driven by means of a carrier pin carried by the thread supply device so that the drum rolls along on a housing-fixed rolling path. The gearing arrangement couples the storage drum to the thread supply device in such a manner that the storage drum stands still with respect to the housing as the thread supply device is rotatably driven. This gearing arrangement engages the drum axle which is fixedly connected to the storage drum and is supported rotatably on the thread supply device, and the thread channel is arranged at a radial distance from the drum axis and extends substantially rectilinearly.

22 Claims, 4 Drawing Figures

1
15
8
17
8a
18
16
d2
d1
10
11a
7
12
D2
D1
11

THREAD STORAGE AND DELIVERY DEVICE

BACKGROUND OF THE INVENTION

The invention relates to a thread storage and delivery device for textile machines, comprising a housing, a thread supply device with a thread channel, which thread supply device is supported rotatably in the housing and can be driven for rotation, a rotatably supported overhung drum axle, a storage drum, and a gearing arrangement with at least one driven wheel which can be driven by means of a carrier pin carried by the thread supply device and which rolls along a housing-fixed rolling path, whereby the gearing arrangement couples the storage drum to the thread supply device in such a manner that the storage drum stands still with respect to the housing as the thread supply device is rotatably driven.

Such a thread storage and delivery device is known. It has a drum axle which is supported in the housing at its end which is remote from the drum, and which can be rotatably driven through a drive wheel supported on the axle by means of a pin coupling. Furthermore, the axle has spaced from its end an angled hollow arm. The axle is also hollow between its end which is remote from the drum and the arm. This results in a double bend in the thread channel. By rotating the drum axle, the thread which exits at the co-rotating arm is wound onto the drum. The gearing arrangement, which takes care of the standstill of the storage drum, has two planetary gears and two internal ring gears on which said planetary gears roll. One internal gear is arranged inside the storage drum on its winding-up end. The second internal gear, with the same diameter, is supported fixedly in the housing. The planetary gears are connected by a carrier pin, which in turn is supported in an arm which projects from the drum axle and rotates with same. When the drum axle rotates, the planetary gears are carried along, and the planetary gear which runs on the toothed rim of the drum exerts a rotary impulse (i.e., angular moment) onto the drum, which rotary impulse is just as great as and oppositely directed to the rotary impulse which is applied to the drum from the bearings located between the drum axle and the drum. The two rotary impulses cancel one another, whereby the drum is maintained stationary in spite of the rotation of the drum axle relative to the housing. In this known device, this effect is achieved by expensive bearing arrangements between the drum axle and the storage drum, and by the necessity of having to deliver the thread co-axially through the drum, namely through the hollow drum axle, and then guide it until its exit from the double bent thread channel. The threading of the device is thus complicated and time consuming due to the deflections of the thread, which is of great importance due to the large number of devices on a textile machine. Furthermore, the thread is stressed by friction.

The purpose of this invention is to produce a device of the above described type, in which a gearing arrangement prevents rotation of the storage drum, and in which a substantially friction free thread delivery is made possible with simple means.

The purpose is attained inventively by the gearing arrangement engaging the drum axle which is connected fixedly to the storage drum and is supported rotatably on the thread supply device, and by the thread channel being arranged conventionally at a radial distance from the drum axle and being substantially rectilinear.

The inventive device is economical in manufacture and design. The storage drum is constructed only to perform its winding task, without an additional gearing member, and the drum axle is constructed massively as a throughgoing shaft without projecting arms. Furthermore, the axle can be connected to a gearing arrangement with simple means and the axle is better suited, more so than the sensitive drum, to absorb the stresses caused by the oppositely directed rotary impulses. An important advantage of the arrangement consists in the thread being able to be guided without deflection toward the rectilinear thread channel and in it. This makes threading easy and quick, and the thread is less stressed during processing.

A drive wheel can be fixedly connected to the driven wheel and can be coupled through a driving belt to a belt pulley which is arranged fixed with respect to rotation on the drum axle and is rotatably supported concentrically of the thread supply device, whereby the diameters of the drive wheel and the belt pulley have a relationship (ratio) to one another which is the same as the relationship (ratio) between the diameter of the driven wheel and the diameter of the rolling path. The drum axle and thus the drum are supported in an overhung manner on the thread supply device without any other connection to the housing. One single pivot bearing is needed between thread supply device and drum axle. The structure is thus particularly simple and inexpensive, which means a considerable savings because of the large number of thread storage and delivery devices needed for a textile machine.

In a simple manner it is possible to provide an additional support for the carrier pin in the form of an outer support arranged co-rotatingly on the thread supply device, which outer support is spaced from the axis of the thread supply device such that the gearing is arranged between the thread supply device and the outer bearing therefor.

BRIEF DESCRIPTION OF THE DRAWINGS

One exemplary embodiment of the invention is illustrated in connection with the drawings, in which.

DETAILED DESCRIPTION

Figure 1:
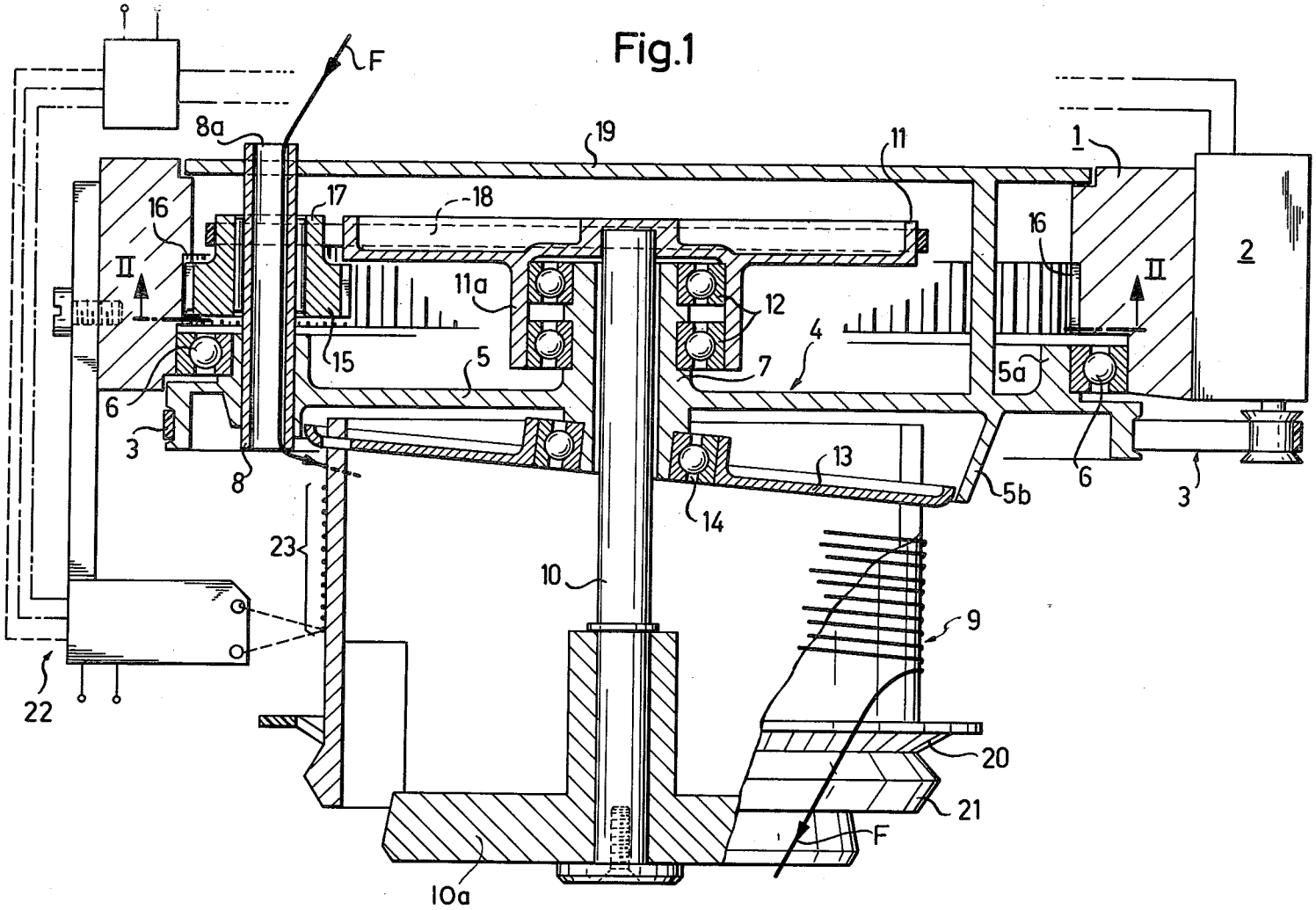
FIG. 1 illustrates, partly in section, the inventive thread storage and delivery device.

A motor 2 is arranged in a housing 1, which motor drives a belt 3. A thread supply device, which as a whole is identified with reference numeral 4, has a support member 5 with an annular flange 5*a*. The member 5 is rotatably supported on the housing 1 by ball bearings 6 and can be driven in rotation through the belt drive 3. The support member 5 has a sleeve 7 which is concentric with respect to the annular flange. The tubular carrier pin 8 is mounted fixedly in the annular flange 5*a* and extends parallel with respect to the sleeve 7.

A thread drum which as a whole is identified by reference numeral 9 is nonrotatably fixedly connected to the axle or shaft 10 in a conventional manner. For example, the drum 9 is nonrotatably connected to the disk 10*a*, as by means of a key structure or radial spokes, and the disk 10*a* is in turn nonrotatably connected to the axle 10. The axle 10 extends with clearance through the sleeve 7 of the thread supply device and is rotationally fixedly connected to a belt pulley 11 at its one end which is remote from the drum. The belt pulley 11 has a hub 11*a* which is supported rotatably on the outside of the sleeve 7 by means of ball bearings 12. A wobble plate 13 which extends through the thread drum 9 is rotatably supported on the sleeve 7 by means of bearings 14, and is supported within an annular cone 5*b* which is made in one piece with the support member 5.

The carrier pin 8 carries a drive wheel which is supported rotatably thereon and is constructed as a gear 15. The drive wheel 15 rolls along on an annular path which is fixedly arranged in the housing and is constructed as a toothed rim 16. A further drive wheel 17 is supported on the carrier pin 8 concentrically with respect to the gear 15 and made in one piece with it. However, gear 17 is of a smaller diameter, and is coupled through a driving belt 18 to the belt pulley 11. The relationship (ratio) between the diameter $d_1$ of the gear 15 and the diameter $D_1$ of the toothed rim 16 is thereby equal to the relationship (ratio) between the diameter $d_2$ of the drive wheel 17 and the diameter $D_2$ of the belt pulley 11.

Furthermore, an opposed bearing disk 19 for the carrier pin 8 is supported on the support member 5 of the thread supply device 4, which opposed bearing disk 19 forms at the same time a cover over the gearing area of the device, whereby the thread can be supplied through a thread channel 8*a* which extends through the carrier pin 8.

A conventional elastic brake ring 20 is arranged at the lower end of the drum, which ring is supported on a bead 21 formed on the drum. Furthermore, a schematically indicated control device 22 is associated with the device for controlling the size of the thread storage 23, which thread storage is controlled by a photo cell.

The discussed device operates as follows: To form a thread storage 23, the motor 2 through the belt drive 3 causes rotation of the thread supply device 4. The gear 15 is forced through the carrier pin 8 to also carry out a circular movement which is concentric with respect to the drum axle 10, whereby the gear 15 rolls along the toothed rim 16. The direction of rotation of the rolling movement results in a direction of rotation of the gear 15 which is opposite to the direction of rotation of the thread supply device 4. The drive wheel 17 rotates automatically with the same angular speed and the same direction of rotation as the gear 15, and also carries out a circular movement about the drum axis. The rotary impulse which the drive wheel 17 exerts through the driving belt 18 onto the belt pulley 11 is, due to the diameter relationships, the same as the rotary impulse which the thread supply device 4 exerts through the bearings 12 onto the belt pulley 11, but, it is directed oppositely. The two rotary impulses thus cancel one another, while the thread supply device 4 rotates, whereby the drum axle 10 and the thread drum 9 stand still relative to the housing.

A thread F which is supplied from a storage spool (not shown) is pulled through the thread channel 8*a* formed in the carrier pin 8 during its circular movement and is wound up onto the drum 9. The thread windings on drum 9 are shifted by the movement of the wobble plate 13 in the direction to the drum end which is remote from the bearings 12 and form the thread storage 23, the size of which is regulated by the control device 22. The thread F is then pulled axially off the drum through the brake ring 20 and over the bead 21 and is fed to a textile machine.

The invention is not limited to the exemplary embodiment. In place of the toothed rim 16 and gear 15 which rolls thereon, the rolling path and driven wheel can have friction surfaces rather than teeth. Within the scope of the invention it is also possible to arrange the thread channel 8*a* separate from the carrier axis. The diameter of the rolling path can, at an unchanged diameter relationship within the gearing arrangement, be smaller than the diameter of the drum, if the rectilinear thread channel 8*a* is inclined relative to the drum axis and is arranged so that its discharge end which is near the drum lies outside of the drum circumference. Of course, the drive wheel and the belt pulley can also have toothed rims and the driving belt can be constructed as a toothed belt.

The gearing arrangement can also have a gear arrangement with an uneven number of wheels in place of a belt drive.

Figure 2:
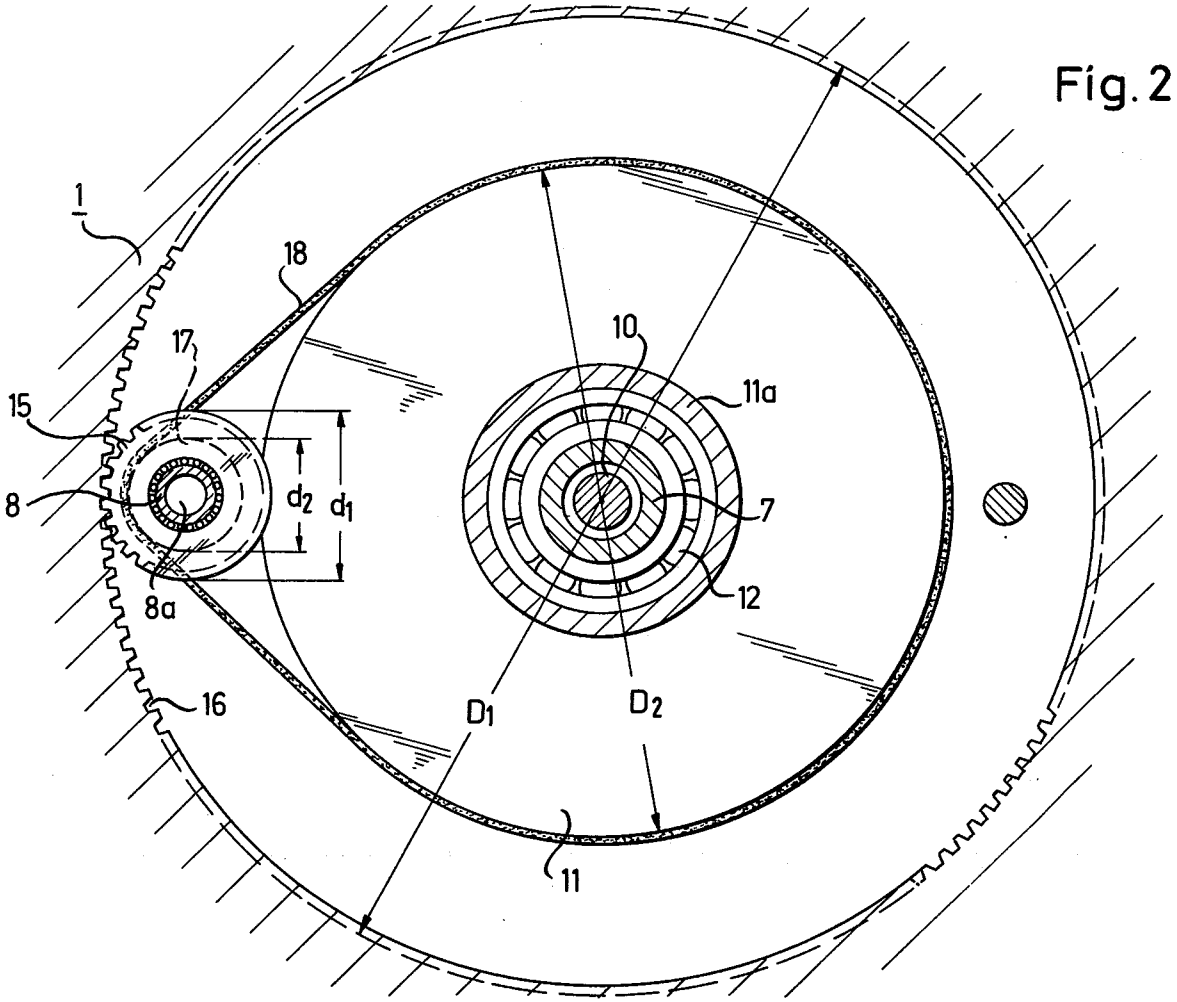
FIG. 2 is a partially schematic cross-sectional view along the line II—II in FIG. 1.
Figure 3:
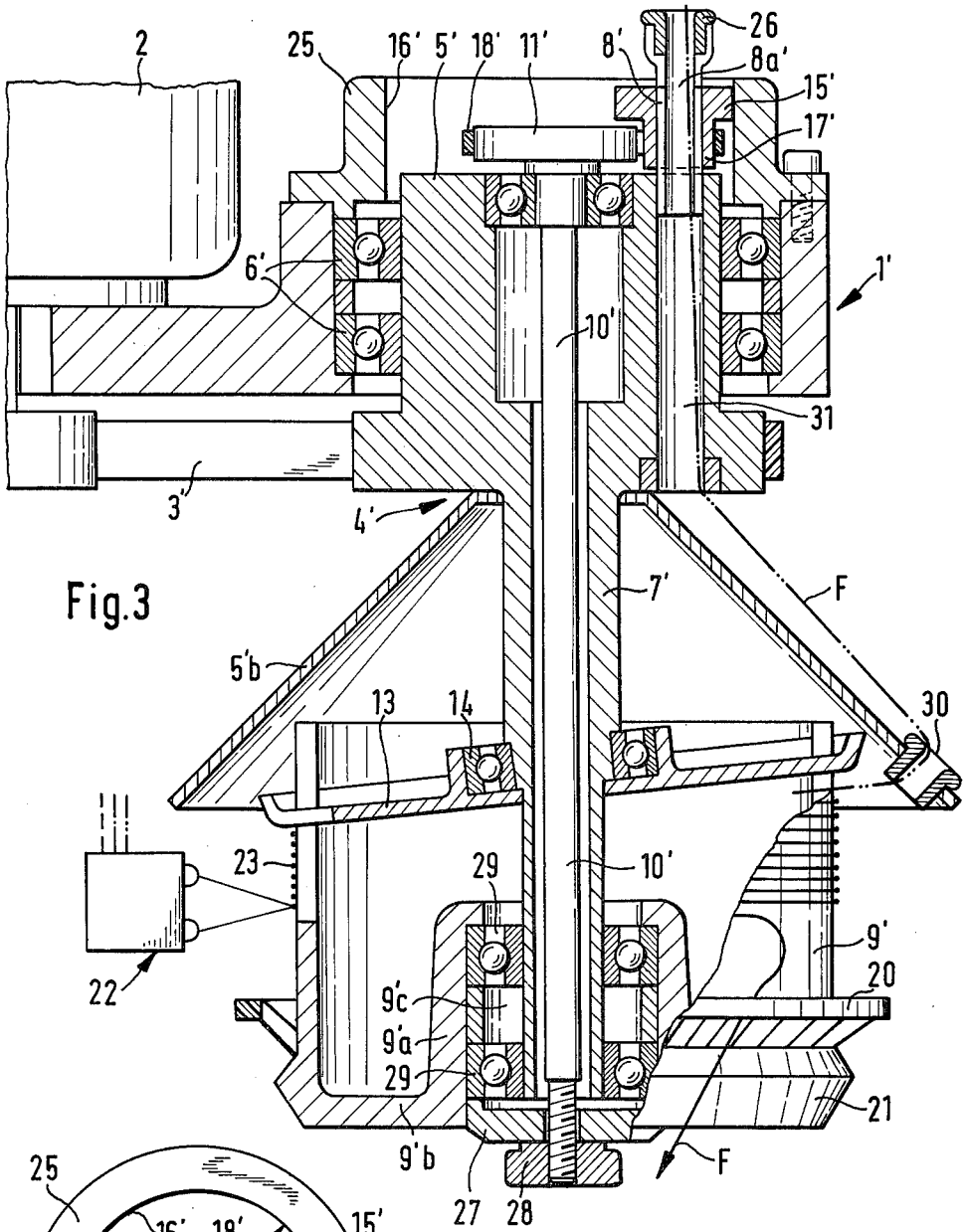
FIG. 3 is similar to FIG. 1 and illustrates a different embodiment of the device.
Figure 4:
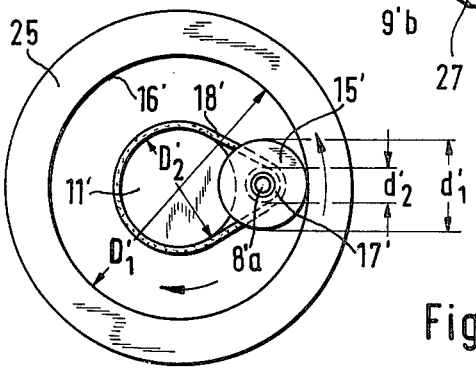
FIG. 4 is a schematic top view of FIG. 3.

In the following description of the embodiment which is illustrated in FIGS. 3 and 4, parts which are the same as those in the embodiment according to FIGS. 1 and 2 have the same reference numerals, and parts of the same type but which differ in form and/or arrangement have the same reference numerals but with an elevated index mark.

In this embodiment, the support member 5' of the thread supply device 4' is constructed as a thick-wall cylinder with annular cross section and is supported by two ball bearings 6' in the housing 1'. The part of the axle 10' which projects over the support member 5' carries the belt pully 11'.

The wall of the support member 5' has parallel to the drum a bore 31 which contains the thread channel 8*a* extending through it. It is extended beyond the drum-remote end area of the support member by the pipe-shaped carrier pin 8', which is secured on the support member in the drum-remote end of the thread channel. The carrier pin carries the drive wheel 17' which is supported rotatably on it and the drive gear 15' which is of one piece with it, the diameter $d_1'$ of which is greater than the diameter $d_2'$ of the drive wheel 17'. Same is arranged between the support member 5' and the driven gear 15' at approximately the same height as the belt pulley 11', with which it is coupled through a driving belt 18'. A rolling path 16' is associated with the driven gear, which rolling path is provided on the inner wall of a flange ring 25 which is connected to the housing 1'.

The diameters $D_1'$ of the rolling path and $D_2'$ of the belt pulley 11' have a relationship to one another the same as the diameters $d_1'$ of the driven gear 15' and $d_2'$ of the drive wheel 17'. The end of the carrier pin 8' which projects over the driven gear 15' and the flange ring 25 carries a thread-channelling nipple 26.

The sleeve 7' is concentrically connected to the support member 5', continuing with its bore the correspondingly tapered annulus. Sleeve 7' encloses with clearance the drum axle 10' up to its end zone which is fixedly connected to the thread drum 9'. The connection takes place by a clamping part 27 and a screwed connection 28. The clamping part 27 thereby closes off a cylinder chamber 9'*c* which is formed by a one-piece hub 9'*a* on the drum end wall 9'*b*, in which cylinder chamber two ball bearings 29 rotatably support the thread drum 9' on the sleeve 7'.

At the transition from the support member 5' to the sleeve 7' there is arranged an annular cone 5'b which enlarges toward the thread drum so that it is mounted with its outer surface adjacent the mouth of the thread channel 8a'. The annular cone extends all around and over the upper drum edge, surrounding both the drum edge and the wobble plate 13 supported on the sleeve 7'. The cone 5'b has, at its edge area which has the shortest distance from the mouth of the thread channel, a thread-guiding eyelet 30 extending approximately perpendicularly through the surface of the cone 5'b.

The operation of the device according to FIGS. 3 and 4 corresponds substantially to the already described operation of the embodiment according to FIGS. 1 and 2. The thread F which is supplied through the thread channel 8a' is guided for winding up additionally by the thread-guiding eyelet 30.

The embodiments of the invention in which an exclusive property or privilege is claimed are defined as follows:

1. In a thread storage and delivery device for textile machines, including a housing, a rotatably driven thread supply device rotatably supported on the housing and defining a thread channel, a rotatably supported drum axle, a storage drum mounted on the drum axle, and a gearing means drivingly coupling the storage drum to the thread supply device in such a manner that the storage drum stands still with respect to the housing as the thread supply device is rotatably driven, said gearing means including at least one driven wheel rotatably supported on and carried by said thread supply device and an annular path fixed with respect to said housing, said driven wheel being engaged with said path and rollingly movable therealong in response to rotation of said thread supply device, comprising the improvement wherein the gearing means drivingly engages and rotates the drum axle which is fixedly connected to the storage drum and is rotatably supported on the thread supply device, and the thread channel being arranged at a radial distance from the drum axis and extending substantially rectilinearly.

2. A device according to claim 1, wherein the gearing means includes a drive wheel fixedly connected with respect to rotation with the driven wheel and coupled through a driving belt to a belt pulley which is arranged fixed with respect to rotation on the drum axle and is supported rotatably on the thread supply device, and wherein the diameters of the drive wheel and of the belt pulley have a ratio to one another the same as the ratio between the diameter of the driven wheel to the diameter of the path.

3. A device according to claim 2, wherein the path is constructed as a toothed rim and the driven wheel as a gear.

4. A device according to claim 2, wherein the thread supply device has a wheel-shaped support member with an annular flange which rotatably supports the thread supply device on the housing, the support member also mounting thereon a carrier pin which supports the driven wheel and a concentric sleeve which surrounds the drum axle with clearance to permit relative rotation therebetween, said sleeve having the belt pulley rotatably supported thereon.

5. A device according to claim 4, wherein the belt pulley has a hub which is fixedly connected to the end of the drum axle and forms an axially projecting bearing ring, said bearing ring being supported rotatably on the outside of the sleeve.

6. A device according to claim 5, wherein the hub is made in one piece with the belt pulley.

7. A device according to claim 1, wherein the driven wheel is rotatably supported on a carrier pin which is mounted on the thread supply device, and said carrier pin containing therein the thread channel.

8. A device according to claim 7, wherein the thread supply device has a co-rotating outer support for supporting the end of the carrier pin which projects beyond the gearing means.

9. A device according to claim 8, wherein the co-rotating outer support is constructed as a cover disk for covering the gearing means.

10. A device according to claim 1, wherein the diameter of the path is larger than the diameter of the storage drum.

11. A device according to claim 1, wherein the diameter of the path is smaller than the diameter of the storage drum.

12. A device according to claim 2, wherein the thread supply device has a support member with annular cross section, said support member being rotatably supported on the housing and having a sleeve which is concentrically connected thereto and surrounds the drum axle with clearance up to an end zone of the storage drum, said sleeve being supported rotatably in the storage drum, the support member containing inside thereof a bearing for rotatably supporting the drum-remote end of the drum axle, and the support member in its wall mounting a carrier pin which projects away from the storage drum and mounts thereon said driven wheel.

13. A device according to claim 12, wherein the thread channel extends through the carrier pin and through a bore formed in the support member in alignment with the carrier pin.

14. A device according to claim 12, wherein the belt pulley is mounted fixedly on the end of the drum axle which is remote from the drum, which end projects from the support member.

15. A device according to claim 12, wherein an annular cone is arranged on the support member, which annular cone enlarges in the direction of the storage drum and extends over the upper drum edge at a distance therefrom, such that an area of the cone surface is positioned adjacent the discharge end of the thread channel, and a thread-guiding eyelet extending approximately perpendicularly through this surface area of the annular cone adjacent the large-diameter free end thereof, whereby the thread is supplied through the channel and then moves outwardly along the cone surface and passes through the eyelet for winding on the drum.

16. A device according to claim 1, wherein the thread supply device includes an annular support member rotatably supported on the housing for rotation about an axis which is substantially aligned with the axis of said drum axle, said drum axle being rotatably supported on said support member, and said support member having means carried thereon and defining said thread channel.

17. A device according to claim 16, wherein the means defining said thread channel comprises a carrier pin which extends generally parallel with the axis of the drum shaft, and said driven wheel being rotatably supported on said carrier pin.

18. A device according to claim 17, wherein said gearing means includes power transmitting means drivingly connected between said driven wheel and said drum axle for causing relative rotation therebetween so that said drum axle remains in a stationary position with respect to said housing as said support member is rotated.

19. A device according to claim 18, wherein said path is defined by a radially inwardly facing annular surface which is concentric with said rotational axis and is disposed in engagement with said driven wheel.

20. A device according to claim 1, wherein the thread supply device is rotatably supported on said housing for rotation about an axis which is aligned with the axis of said axle, said thread supply device including means rotatably supporting said driven wheel for rotation about an axis which is approximately parallel with but radially spaced from the rotational axis of said thread supply device, and said gearing means including rotational power transmitting means drivingly connected between said driven wheel and said axle.

21. A device according to claim 20, wherein said means which rotatably supports the driven wheel on said thread supply device comprises pin means having said driven wheel rotatably supported thereon and defining said thread passage through the interior thereof.

22. A device according to claim 21, wherein said rotational power transmitting means includes a rotary drive member drivingly coupled to and driven from said driven wheel, said drive member also being rotatably supported on said thread supply device, and said power transmitting means also including a rotatable driven member fixed with respect to said axle, said driven member being drivingly connected to and driven by said drive member.

* * * * *